US009834396B2

(12) United States Patent
Aoki

(10) Patent No.: US 9,834,396 B2
(45) Date of Patent: Dec. 5, 2017

(54) SHEET CONVEYANCE APPARATUS, IMAGE RECORDING APPARATUS AND FEED TRAY

(71) Applicant: BROTHER KOGYO KABUSHIKI KAISHA, Nagoya-shi, Aichi-ken (JP)

(72) Inventor: Hirotaka Aoki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/501,575

(22) Filed: Sep. 30, 2014

(65) Prior Publication Data

US 2015/0158681 A1 Jun. 11, 2015

(30) Foreign Application Priority Data

Dec. 6, 2013 (JP) ..... 2013-252882

(51) Int. Cl.

| | |
|---|---|
| ***B65H 3/52*** | (2006.01) |
| ***B65H 3/06*** | (2006.01) |
| ***B65H 1/26*** | (2006.01) |
| ***B65H 3/56*** | (2006.01) |

(52) U.S. Cl.

CPC ..... *B65H 3/0684* (2013.01); *B65H 1/266* (2013.01); *B65H 3/56* (2013.01); *B65H 2405/1132* (2013.01); *B65H 2405/1136* (2013.01)

(58) Field of Classification Search

CPC ..... B65H 2405/111; B65H 2405/1111; B65H 2405/1112; B65H 2405/1113; B65H 2405/11131; B65H 2405/1114; B65H 2405/11141; B65H 2405/1115; B65H 2405/1151; B65H 2405/1138; B65H 2405/2111; B65H 3/0684; B65H 1/266;

(Continued)

(56) References Cited

U.S. PATENT DOCUMENTS 5,975,518 A * 11/1999 Wakana et al. ..... 271/121
7,435,025 B2 * 10/2008 Tanahashi et al. ..... 400/625

(Continued)

FOREIGN PATENT DOCUMENTS

CN 1760101 A 4/2006
JP 60-177127 U 11/1985

(Continued)

OTHER PUBLICATIONS

Chinese Office Action issued in related Chinese patent application No. 201410497930.2, dated Apr. 6, 2016.

(Continued)

*Primary Examiner* — Thomas Morrison
(74) *Attorney, Agent, or Firm* — Merchant & Gould P.C.

(57) ABSTRACT

A sheet conveyance apparatus includes: a support member having a support surface configured to support sheets, a feed unit configured to feed the sheets stacked on the support surface in a feed direction, a guide member provided on the downstream side of the support member in the feed direction, and a separating member projecting from an inclined surface of the guide member toward the support surface. The inclined surface is curved such that a separating area where the separating member is provided comes closest to the side of the support surface. The support surface has a first support surface located on the immediate upstream side in the feed direction to correspond to the separating area, and second support surfaces arranged respectively on both sides of the first support surface in a direction orthogonal to the feed direction to be lowered than the first support surface.

5 Claims, 8 Drawing Sheets

(58) Field of Classification Search
CPC ..... B65H 3/56; B65H 2405/1132; B65H 2405/1136
USPC ..... 271/121, 122, 124, 114, 117, 118
See application file for complete search history.

(56) References Cited

U.S. PATENT DOCUMENTS

| | | | | |
|---|---|---|---|---|
| 8,424,867 | B2 * | 4/2013 | Morisaki | 271/121 |
| 2005/0196216 | A1 | 9/2005 | Tanahashi et al. | |
| 2006/0082043 | A1 | 4/2006 | Ikeda | |

FOREIGN PATENT DOCUMENTS

| | | | |
|---|---|---|---|
| JP | 2859836 | B2 | 2/1999 |
| JP | 2005-247544 | A | 9/2005 |
| JP | 2013-116796 | A | 6/2013 |

OTHER PUBLICATIONS

Office Action from corresponding Chinese Patent Application No. 201410497930.2, dated Dec. 1, 2016.
Notice of Reasons for Rejection from corresponding Japanese Patent Application No. 2013-252882, dated Nov. 22, 2016.
Office Action mailed in related Chinese application No. 201410497930.2, dated May 31, 2017.
Decision of Rejection of corresponding Chinese Patent Application No. 201410497930.2, dated Aug. 31, 2017. English translation is attached.

* cited by examiner

SHEET CONVEYANCE APPARATUS, IMAGE RECORDING APPARATUS AND FEED TRAY

CROSS REFERENCE TO RELATED APPLICATION

The present application claims priority from Japanese Patent Application No. 2013-252882, filed on Dec. 6, 2013, the disclosure of which is incorporated herein by reference in its entirety.

BACKGROUND

Field of the Invention

The present invention relates to a sheet conveyance apparatus separating and feeding a plurality of sheets supported by a support surface, an image recording apparatus provided with the conveyance apparatus, and a feed tray.

Description of the Related Art

Conventionally, there is known an image recording apparatus provided with a sheet conveyance apparatus in which a plurality of sheets are supported by a support surface in a stacked state and which separates and feeds the topmost one sheet among the plurality of sheets. In such a sheet conveyance apparatus, conveyance direction of the sheets fed from the support surface by a feed unit such as a feed roller is changed by an inclined surface, and the front ends thereof are separated by separating member provided on the inclined surface.

The separating member includes, for example, a plurality of metallic projecting pieces which are aligned along the conveyance direction to project respectively from the inclined surface toward the support surface. As the sheets are fed in the conveyance direction, a part of the front end portions of the sheets is bent by abutting against the separating pieces, and passes over the separating pieces because of the intension of the sheets (that is, the resilience of the sheets). In this manner, due to the movement of a part of the front end portions of the sheets passing over the separating pieces, the front end portions of the sheets in the stacked state are separated. In particular, as the topmost sheet is in contact with the feed roller and being fed in the conveyance direction, it passes over the separating pieces and is conveyed further, whereas the underlaid sheets, which are attached to the topmost sheet due to friction force and the like and moved in the conveyance direction, are stopped by the separating pieces and thus cannot pass over the separating pieces.

SUMMARY

In a manufacturing process of recording sheets as an example of such sheets, a plurality of recording sheets are cut out into a predetermined size in a stacked state. When the plurality of recording sheets are cut out, there is a possibility that burrs are formed at edges of the recording sheets. When the recording sheets with such burrs are packed without being separated and supplied to the market and if the recording sheets are used in a sheet conveyance apparatus or the like, there is a problem that it is difficult to separate the recording sheets in a stacked state. Such difficulty to separate the recording sheets due to the burrs of the recording sheets varies depending on difference in manufacturers, difference in lot numbers, etc. Therefore, on the market, there are types of the recording sheets which are easy to separate and types of the recording sheets which are difficult to separate.

For example, in the sheet conveyance apparatus described above, if the separating pieces projecting from the inclined surface are lengthened, then it may improve the ability to separate the recording sheets with the burrs. However, because there are a wide variety of sheets to be conveyed by the sheet conveyance apparatus, if the separating pieces projecting from the inclined surface are lengthened, then the recording sheet less likely to bend (that is, with a higher resilience), such as gloss paper, is liable to suffer a greater damage due to the abutment against the separating pieces. For example, deformation is liable to occur in end portions of the gloss paper, and/or the gloss paper is liable to suffer surface damage.

The present teaching is made in view of the problems described above, and an object thereof is to provide a means for improving the ability to separate the sheets which are supported by a support surface and fed.

According to a first aspect of the present teaching, there is provided a sheet conveyance apparatus including: a support member having a support surface configured to support sheets in a stacked state; a feed unit configured to feed the sheets stacked on the support surface in a feed direction; a guide member provided on a downstream side of the support member in the feed direction, and having an inclined surface which is inclined with respect to the support surface such that one end on a downstream side in the feed direction is located above the other end on an upstream side in the feed direction and which is configured to abut against the sheets fed by the feed unit and to guide the sheets along the feed direction; and a separating member projecting from the inclined surface toward a side of the support surface and configured to separate the topmost sheet from the other sheets fed by the feed unit, wherein the inclined surface is curved such that a separating area in which the separating member is provided is closest to the side of the support surface, and the support surface includes: a first support surface arranged on a downstream side of the feed unit in the feed direction to be adjacent to the separating area on an upstream side of the separating area in the feed direction, and second support surfaces arranged respectively on both sides of the first support surface in a direction orthogonal to the feed direction and lowered from the first support surface in the gravity direction.

A plurality of sheets in a stacked state are supported by the first support surface and the second support surfaces. On an immediate upstream of the inclined surface, the first support surface corresponding to the separating area, at which the separating member is provided, is higher in the gravity direction than the second support surfaces which are arranged respectively on both sides of the first support surface in the direction orthogonal to the feed direction. Therefore, in the immediate upstream of the inclined surface, any of the sheets is bent domically so that a part corresponding to the separating area is heightened and the other parts on the two lateral sides are lowered. If any of the sheets bent in this manner is fed in the feed direction, then the part of the sheet corresponding to the separating area, that is, the peak of the domical shape, comes first to abut against the separating member. Therefore, a force in the feed direction imparted by the feed unit is transmitted efficiently as the force for the sheet to abut against the separating member.

According to a second aspect of the present teaching, there is provided an image recording apparatus including: the sheet conveyance apparatus according to the first aspect; and a recording unit configured to record images on the sheets conveyed by the sheet conveyance apparatus.

According to a third aspect of the present teaching, there is provided a feed tray including: a support surface configured to support a sheet to be fed in a predetermined feed direction, wherein the support surface includes: a first support surface arranged on one end side in the feed direction; and second support surfaces arranged respectively on both sides of the first support surface in a direction orthogonal to the feed direction and lowered from the first support surface in the gravity direction.

According to the present teachings, any of the sheets is domically bent by the first support surface and the second support surfaces such that the peak thereof comes to abut against the separating member at the beginning of the feeding. Therefore, the ability to separate the sheets is improved.

DESCRIPTION OF THE EMBODIMENT

Figure 1:
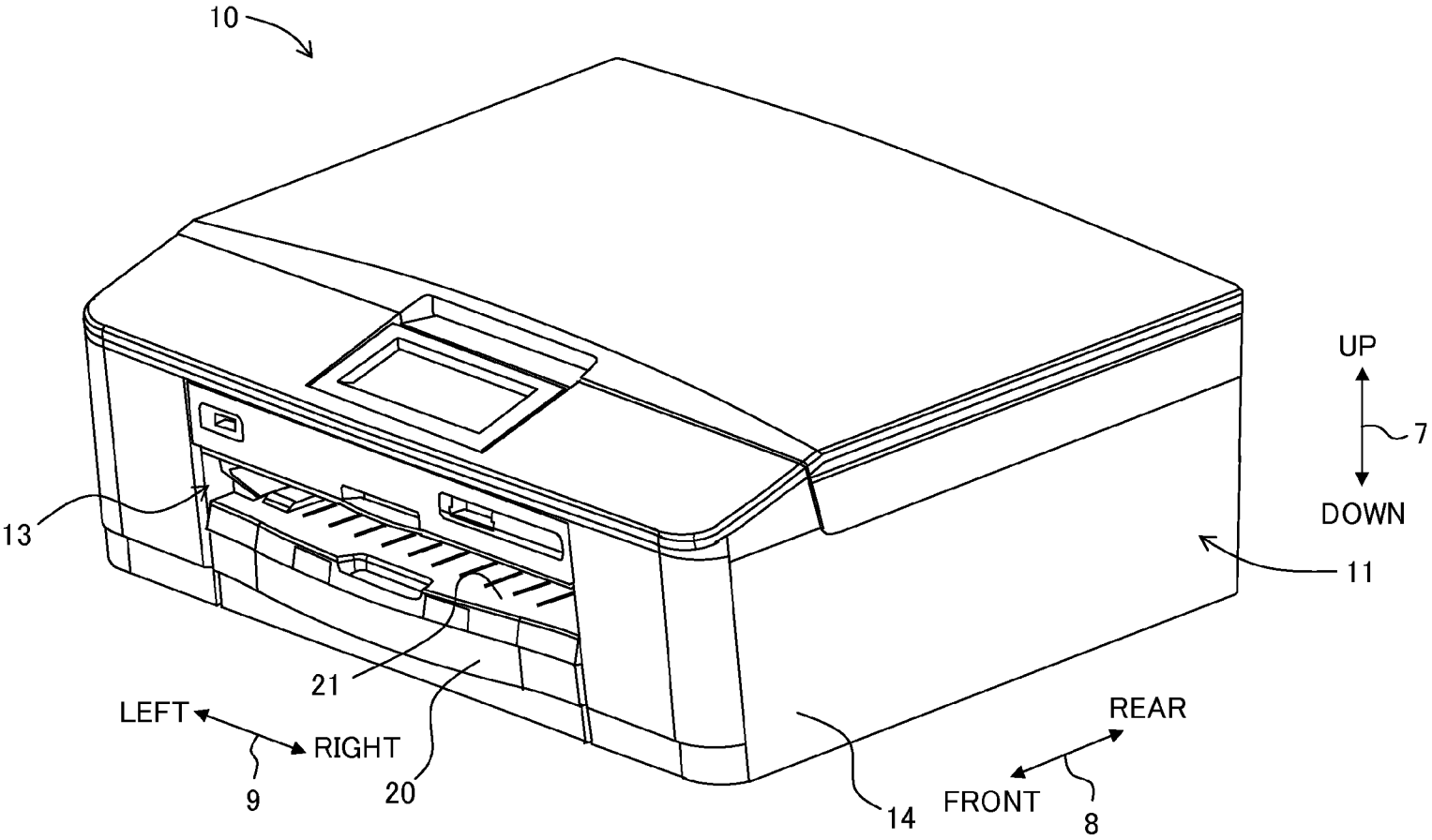
FIG. 1 is a perspective view of a multifunction peripheral.

Hereinbelow, an embodiment of the present teaching will be described. Further, it is needless to say that the embodiment described below is merely one example of the present teaching, and thus it is possible to change the embodiment of the present teaching as appropriate without departing from the gist or spirit of the present teaching. Further, in the following description, an up-down direction 7 is defined, with reference to a state in which a multifunction peripheral 10 is operably placed, a front-rear direction 8 is defined with reference to that a portion of the multifunction peripheral 10 on which an opening 13 is provided is a near side (front side), and a left-right direction 9 is defined with reference to a view from a view point in front of the multifunction peripheral 10.

<Overall Configuration of the Multifunction Peripheral 10>

As depicted in FIG. 1, the multifunction peripheral 10 includes a printer unit 11 of an ink jet method. The multifunction peripheral 10 has a variety of functions such as facsimile function, print function, etc. The printer unit 11 corresponds to an image recording apparatus provided with the sheet conveyance apparatus.

The printer unit 11 has a case 14 formed to have a substantially rectangular parallelepiped shape. The opening 13 is formed in a front surface of the case 14. A feed tray 20 and a discharge tray 21 are provided to be insertable into and removable from the case 14 through the opening 13 in the front-rear direction 8. Further, the feed tray 20 and the discharge tray 21 may be configured as either can be completely removed from the case 14 or can be drawn out midway from the state of being installed in the case 14 but cannot be completely removed from the case 14. Recording sheets 12 of a desired size such as the A4 size, the B5 size, or the like according to Japanese Industrial Standards are placed on the feed tray 20 in a stacked state.

Figure 2:
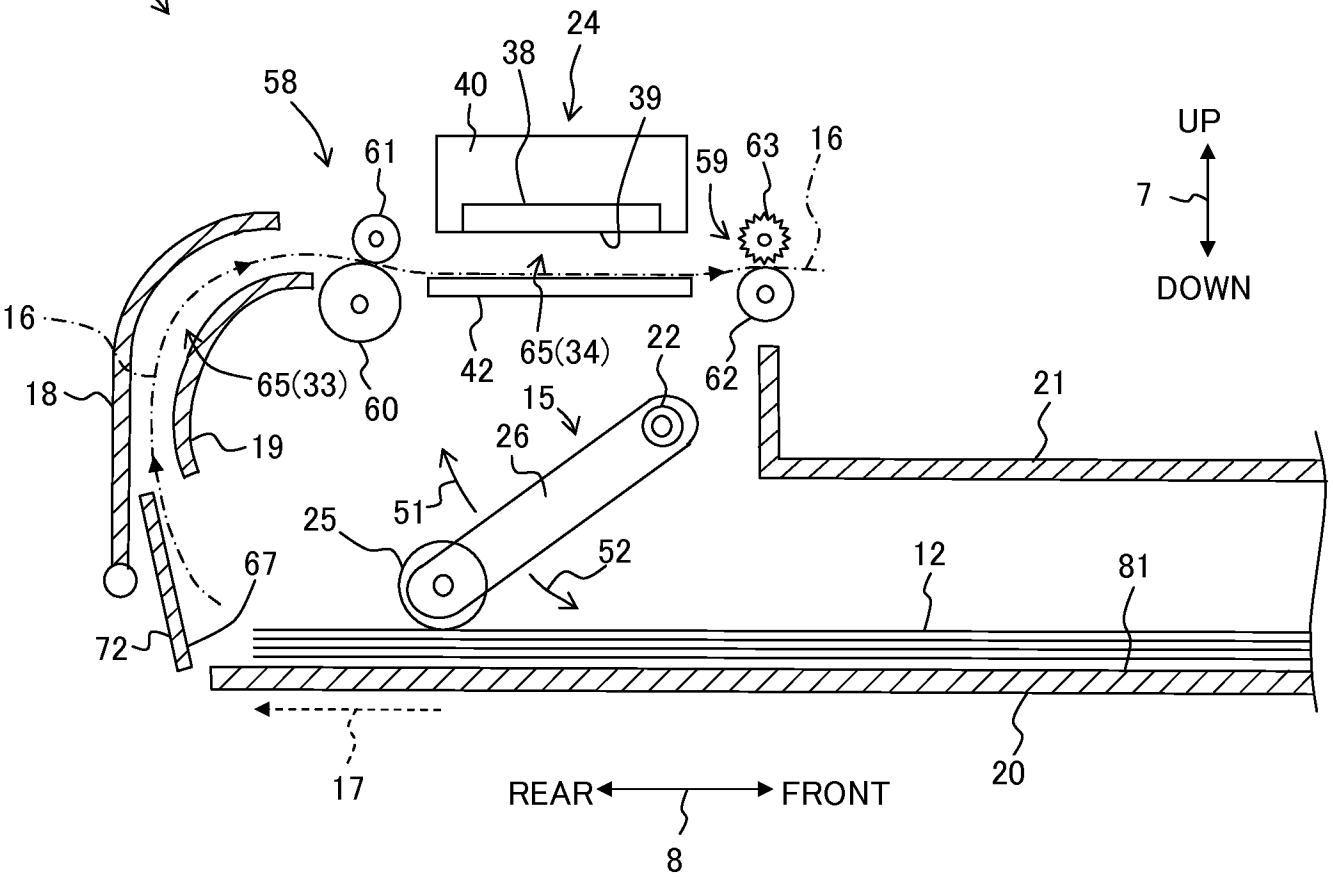
FIG. 2 is a vertical cross-sectional view schematically depicting an internal structure of a printer unit.

As depicted in FIG. 2, the printer unit 11 includes a conveyance roller pair 58 and a discharge roller pair 59 adapted to convey the recording sheet 12, a recording unit 24 of the ink jet method adapted to record images on the recording sheet 12, and the like. Further, the recording unit 24 is not limited to the ink jet method, but may apply, for example, an electrophotographic method.

A conveyance path 65 is provided inside the case 14. The conveyance path 65 has a curved portion 33 extending upward from the rear end of the feed tray 20 to reverse frontward, and a linear portion 34 extending frontward from the curved portion 33 along the front-rear direction 8. The curved portion 33 is defined by an outer guide member 18 and an inner guide member 19 facing each other at a predetermined interval. The linear portion 34 is defined by the recording unit 24, a platen 42, and the like.

Further, in FIG. 2, a conveyance direction 16 is indicated by the arrows on a one-dot chain line. The conveyance direction 16 changes its orientation along the conveyance path 65.

<Feed Unit 15>

Figure 5:
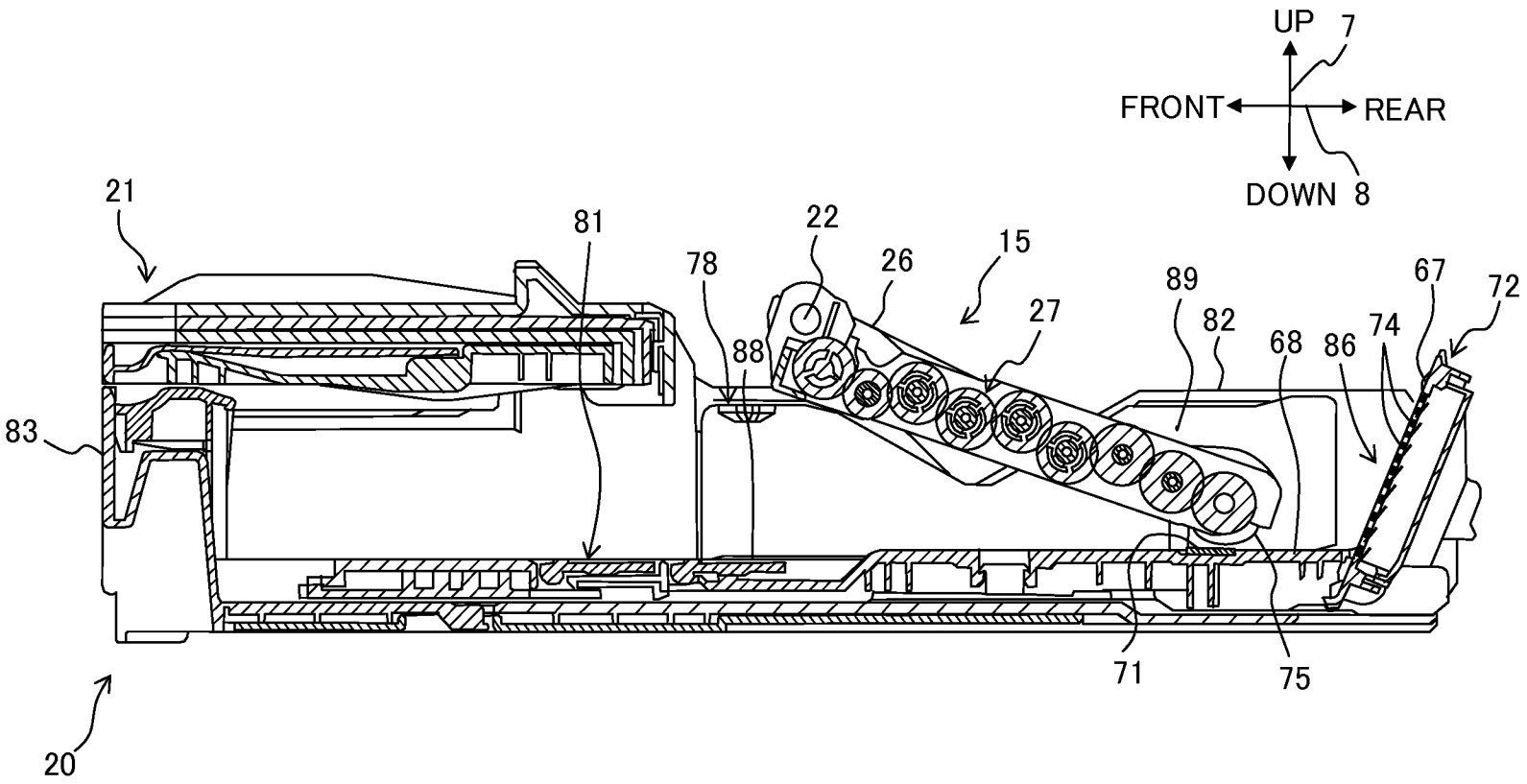
FIG. 5 is a cross-sectional view depicting a cross section along the line V-V of FIG. 4.
Figure 6:
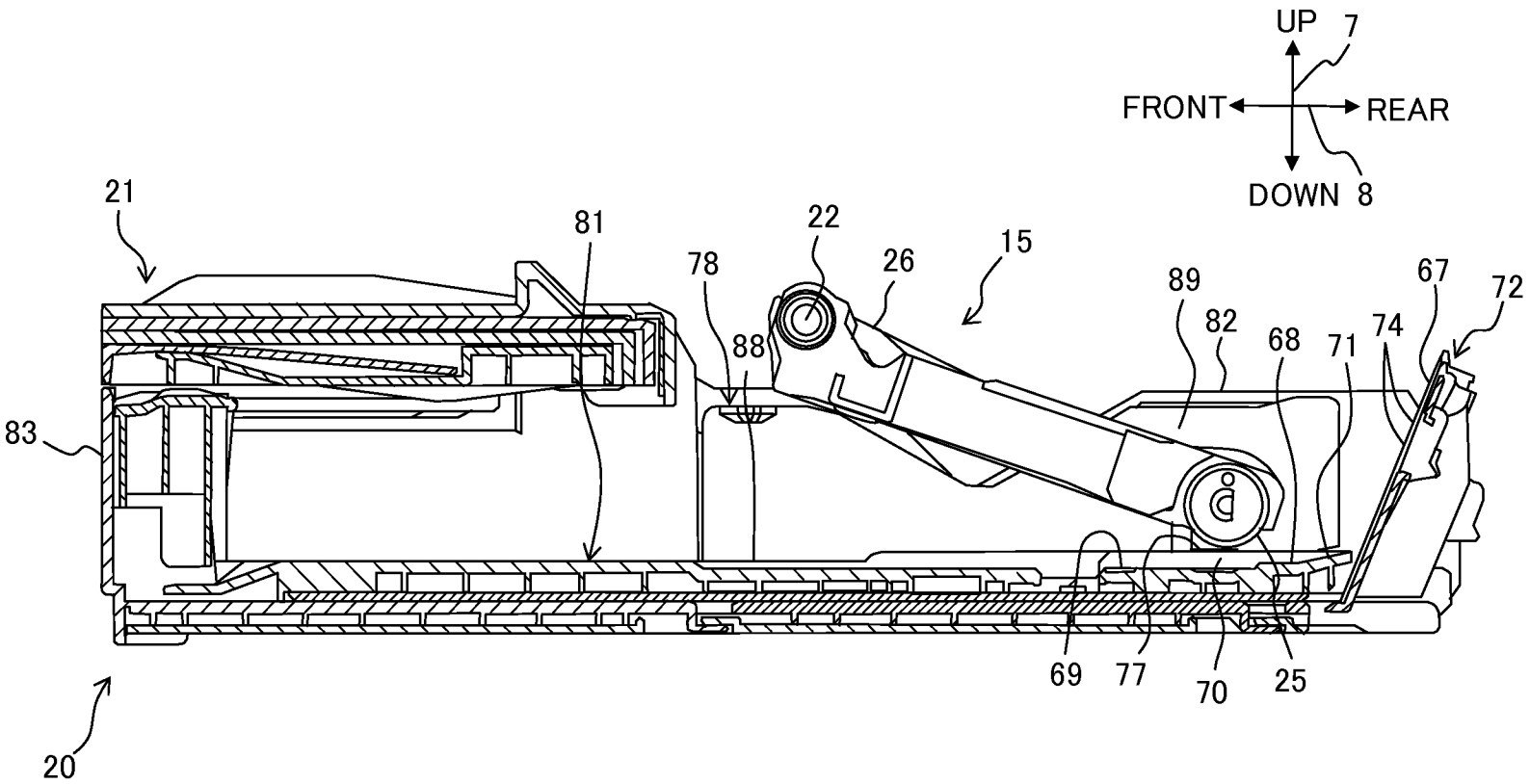
FIG. 6 is a cross-sectional view depicting a cross section along the line VI-VI of FIG. 4.

As depicted in FIG. 2 and FIG. 5, a feed unit 15 is provided above the feed tray 20. The feed unit 15 includes a feed roller 25, a feed arm 26, a driving force transmission mechanism 27, and a shaft 22. However, illustration of the driving force transmission mechanism 27 is omitted in FIG. 2.

The shaft 22 is provided at one end side of the feed arm 26. The feed arm 26 is pivotable around the shaft 22 in the directions indicated by arrows 51 and 52. The feed roller 25 is rotatably supported by the other end of the feed arm 26. The one end of the feed arm 26 is located obliquely above and at the front side of the other end. The feed arm 26 is biased by its own weight or by a biasing member such as a spring or the like in the direction indicated by the arrow 52. With this, the feed roller 25 abuts against the topmost sheet of the recording sheets 12 supported on the upper surface of a support plate 81 in a stacked state.

The feed roller 25 and the feed arm 26 are provided in the same position as a central portion 86 of a guide member 72 in the left-right direction 9. With the feed tray 20 installed in the case 14, the central portion of the guide member 72 coordinates with the central portion of the feed tray 20.

The feed roller 25 is rotated by a driving force transmitted from a motor (not depicted) via the driving force transmission mechanism 27. On receiving the rotation of the feed roller 25, the topmost sheet of the recording sheets 12 accommodated in the feed tray 20 is fed in a feed direction 17. The driving force transmission mechanism 27 is constructed from a gear row formed of a plurality of directly engaged gears.

<Guide Member 72>

The guide member 72 is provided on the case 14 at the rear side of the feed tray 20 installed in the case 14. The guide member 72 may either be attached to the case 14 or be formed integrally with the case 14.

Figure 4:
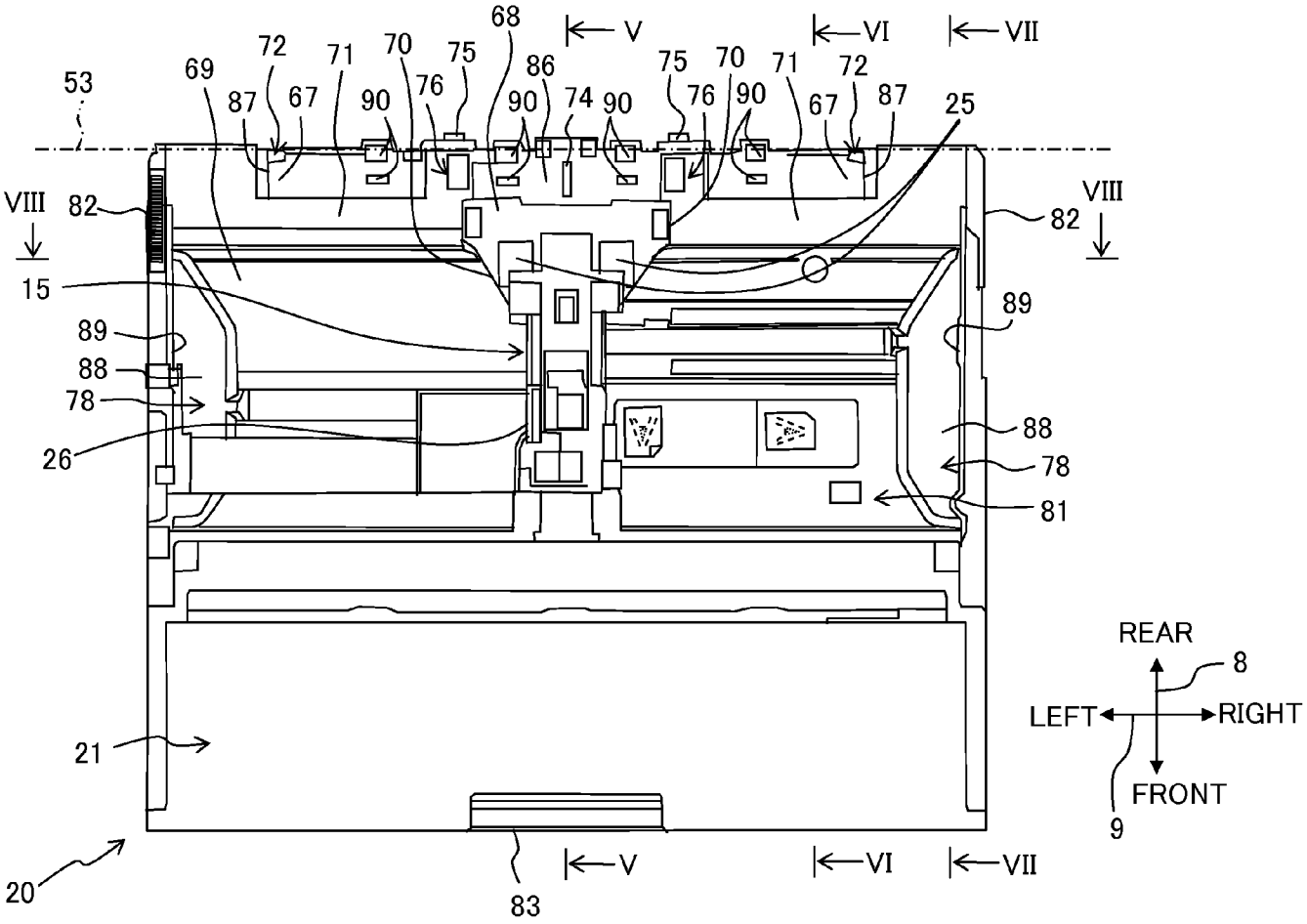
FIG. 4 is a plan view of the feed tray, the discharge tray, a guide member, and a feed unit, depicting a state that the feed tray is installed in a case.

As depicted in FIG. 2 and FIG. 4, the guide member 72 has an inclined surface 67 inclined such that rear side thereof is located above front side thereof in the front-rear direction 8. The inclined surface 67 is a surface of the guide member 72 at the front side. The inclined surface 67 is adapted to abut against the recording sheet 12 fed by the feed unit 15 in the feed direction 17 to guide the recording sheet 12 along the inclined surface 67 in the conveyance direction 16.

Further, the guide member 72 may be constructed from a plurality of ribs arranged at intervals in the left-right direction 9. In this case, the inclined surface 67 is constructed from the aggregation of end surfaces of the plurality of ribs. Of course, the inclined surface 67 may be a flat surface, and a plurality of ribs may be provided to stand from that surface. In this case, the end surfaces of the plurality of standing ribs constitute a part of the inclined surface 67.

As depicted in FIG. 4, the inclined surface 67 is curved such that the central portion 86 may be at the front side of end portions 87 in the left-right direction 9. Therefore, with the feed tray 20 installed in the case 14, in the inclined surface 67, the central portion 86 is closest to a first support surface 68 of the feed tray 20. Note that, in FIG. 4, an auxiliary line 53 is depicted for illustrating the curvature of the inclined surface 67.

A plurality of separating teeth 74 are aligned in the up-down direction 7 and project from the inclined surface 67 in the central portion 86 of the inclined surface 67 in the left-right direction 9. The separating teeth 74 stop, from moving in the feed direction 17, the recording sheets 12 laid under the topmost recording sheet 12 fed by the feed roller 25 in the feed direction 17, by contact with the recording sheets 12 fed from the feed tray 20. The topmost recording sheet 12 fed by the feed roller 25 passes over the separating teeth 74 to come into the conveyance path 65. The central portion 86 corresponds to the separating area. The separating teeth 74 correspond to the separating member.

Eight rollers 90 are rotatably attached to the guide member 72. The rollers 90 are provided in openings and recesses formed in the guide member 72, and parts of their circumferential surfaces project from the inclined surface 67. The rollers 90 are arranged symmetrically in the left-right direction 9 at both sides of the separating teeth 74.

<Recording Unit 24>

As depicted in FIG. 2, the recording unit 24 is provided above the platen 42. The recording unit 24 and the platen 42 define a part of the linear portion 34. The platen 42 is a member adapted to support the recording sheet 12. The recording unit 24 includes a carriage 40 and a recording head 38.

The carriage 40 is supported to reciprocate in the left-right direction 9 by two guide rails (not depicted) arranged at an interval in the front-rear direction 8. The recording head 38 is mounted on the carriage 40. The recording head 38 is supplied with ink from an ink cartridge (not depicted). Nozzles 39 are provided in a lower surface of the recording head 38. While the carriage 40 is moving in the left-right direction 9, the recording head 38 ejects ink droplets from the nozzles 39 toward the platen 42. Thus, an image is recorded on the recording sheet 12 by letting the ink droplets land on the recording sheet 12 supported by the platen 42.

<Conveyance Roller Pair 58 and Discharge Roller Pair 59>

As depicted in FIG. 2, the conveyance roller pair 58 is arranged on the upstream side of the recording unit 24 in the conveyance direction 16. The discharge roller pair 59 is arranged on the downstream side of the recording unit 24 in the conveyance direction 16.

The conveyance roller pair 58 includes a conveyance roller 60, and a pinch roller 61 biased toward the conveyance roller 60 by a coil spring or the like (not depicted). The discharge roller pair 59 includes a discharge roller 62, and a spur roller 63 biased toward the discharge roller 62 by a coil spring or the like (not depicted).

A driving force is transmitted from a motor (not depicted) to the conveyance roller 60 and the discharge roller 62 to rotate the same. The recording sheet 12 is nipped by the conveyance roller pair 58 and the discharge roller pair 59 to be conveyed in the conveyance direction 16.

<Feed Tray 20>

Figure 3:
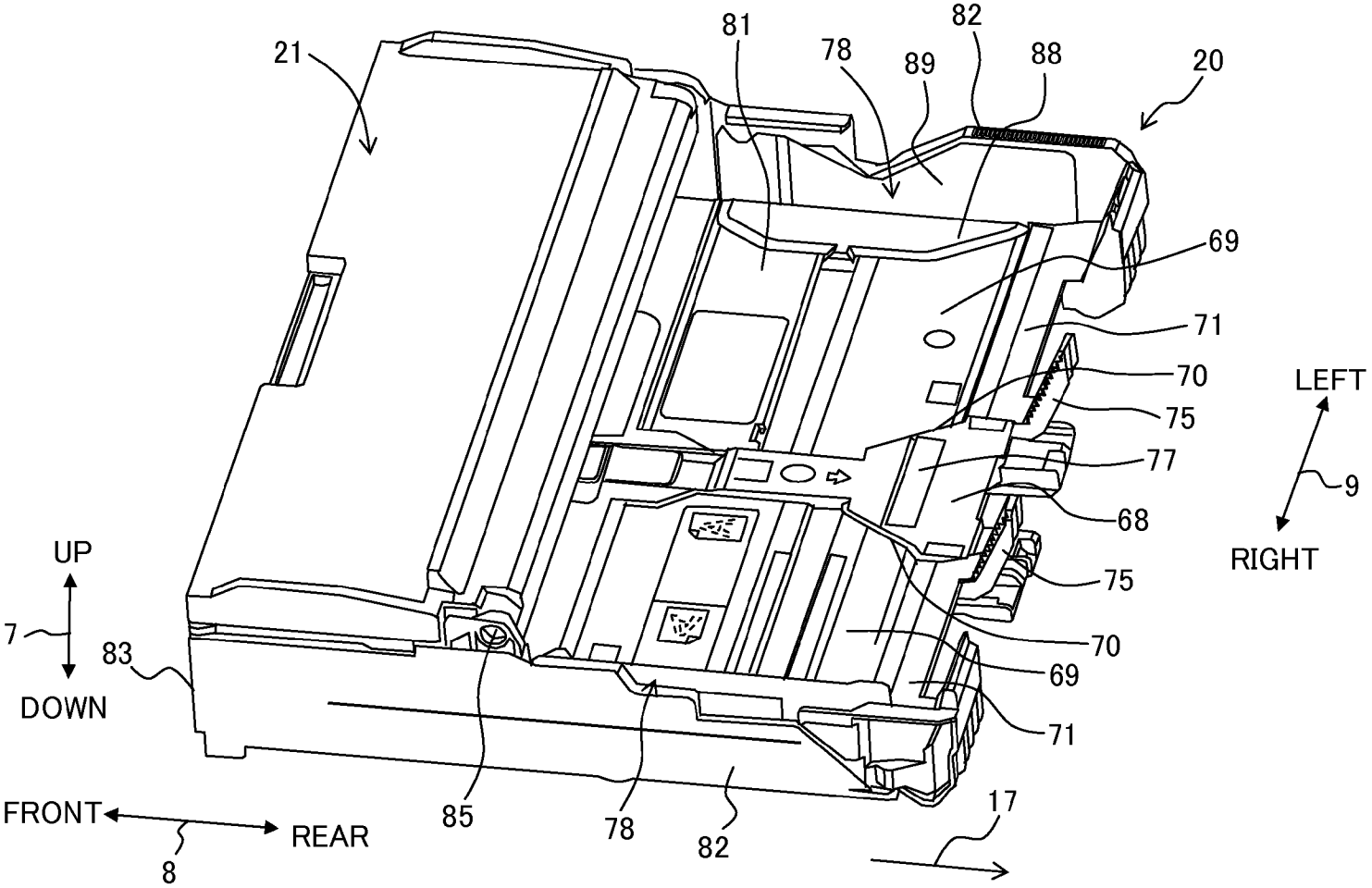
FIG. 3 is a perspective view of a feed tray and a discharge tray.

As depicted in FIG. 3 and FIG. 4, the feed tray 20 has a box-like shape with an open top. The feed tray 20 has the support plate 81 arranged at the bottom side to support the recording sheet 12, a pair of side plates 82 standing upward from the two ends of the support plate 81 in the left-right direction 9 to extend in the front-rear direction 8, and a front plate 83 standing upward from the front end of the support plate 81 to extend in the left-right direction 9. The support plate 81 corresponds to the support member.

The discharge tray 21 is arranged over a front part of the open top of the feed tray 20 in the front-rear direction 8. The discharge tray 21 is supported by the front plate 83 and the pair of side plates 82 of the feed tray 20. The discharge tray 21 is pivotable around a shaft 85 with its front end in the front-rear direction 8 as the pivot front-end. The pivot front-end of the discharge tray 21 is pivoted upward to open and close the upper side of the feed tray 20 on which the discharge tray 21 is arranged.

The support plate 81 supports the recording sheet 12 on the upper surface thereof in a stacked state. The upper surface of the support plate 81 functions as a support surface for the recording sheet 12, and is formed into a concave-convex shape.

Within the upper surface of the support plate 81, the first support surface 68 is provided on an immediate upstream side portion in the feed direction 17 corresponding to the central portion 86 in the left-right direction 9 of the inclined surface 67 of the guide member 72. The first support surface 68 has such a shape as to expand widthwise in the left-right direction 9 such that its downstream end in the feed direction 17 is wider than its upstream end in the feed direction 17. The maximum length of the first support surface 68 in the left-right direction 9 is set to be shorter than the length of the recording sheet 12 of the smallest size in the left-right direction 9 among the recording sheets 12 accommodated in the feed tray 20 to be fed. The first support surface 68 extends up to the rear end of the support plate 81 in the front-rear direction 8.

The first support surface 68 is provided with a friction pad 77 in such a position as spaced apart from the inclined surface 67 toward upstream side in the feed direction 17. The friction pad 77 is constructed of a material with a higher friction coefficient than the material of which the first support surface 68 is constructed. For example, the first support surface 68 is formed of synthetic resin whereas the friction pad 77 is formed of cork. The friction pad 77 has an elongated shape elongated in the left-right direction 9, and is fixed on the support plate 81 to project a little above the first support surface 68. The friction pad 77 is arranged in the central portion of the support plate 81 in the left-right direction 9, and arranged in such a position as contactable with the feed roller 25 of the feed unit 15 in the front-rear direction 8.

Within the upper surface of the support plate 81, second support surfaces 69 are provided respectively on both sides of the first support surface 68 in the left-right direction 9 to dent downward in the up-down direction 7 below the first support surface 68 on the immediate upstream side of the inclined surface 67 of the guide member 72 in the feed direction 17. Each of the second support surfaces 69 extends from the vicinity of the center of the support plate 81 to the rear end in the front-rear direction 8. Between the first support surface 68 and each of the second support surfaces 69, a step surface 70 is formed to extend along the up-down direction 7. Each of the second support surfaces 69 extends up to the left end or the right end of the support plate 81 in the left-right direction 9.

At rear end sides of the respective second support surfaces 69 in the front-rear direction 8, inclined surfaces 71 are provided respectively to be inclined in the front-rear direction 8 such that rear side thereof is located above front side thereof. Each of the inclined surfaces 71 is provided over the entire range, in the left-right direction 9, of the rear end of the corresponding second support surface 69. The lower ends of the inclined surfaces 71 are in respective continuity with the second support surfaces 69. The upper ends of the inclined surfaces 71 are located a little below the first support surface 68.

The inclination angle at the side of a dihedral angle formed between each of the inclined surfaces 71 and a virtual plane including the corresponding second support surface 69 is smaller than the inclination angle at the side of another dihedral angle formed between the inclined surface 67 of the guide member 72 and the virtual plane. That is, the inclined surfaces 71 are inclined more gently than the inclined surface 67 with respect to the virtual plane. The inclined surfaces 71 are configured to abut against the recording sheet 12 fed in the feed direction 17 by the feed unit 15 and guide the recording sheet 12 to the inclined surface 67. Note that, the inclined surfaces 71 may be formed respectively of a plurality of ribs arranged at intervals in the left-right direction 9 to stand upward from the second support surfaces 69. The inclined surfaces 71 correspond to the guide surface.

The support plate 81 is provided with a pair of side guides 78 movable in the left-right direction 9. Each of the side guides 78 has a support portion 88 superimposed on one of the second support surfaces 69 and guide portion 89 projecting upward from the support portion 88. The support portions 88 support the recording sheets 12 on upper surfaces thereof. The upper surfaces of the support portions 88 are situated above the second support surfaces 69 in the up-down direction 7, and at the same height as or a little below the first support surface 68. Each of the guide portions 89 projects upward in the up-down direction 7 from the one of the left end and the right end of the support portions 88 in the left-right direction 9. The pair of guide portions 89 contact respectively with the two ends, of the recording sheet 12 supported by the support plate 81, in the left-right direction 9, so as to guide the two ends of the recording sheet 12 to be fed along the feed direction 17. Note that, although not depicted in detail in each drawing, if one of the pair of side guides 78 is moved along the left-right direction 9, then the other associatively moves contrariwise in the left-right direction 9.

Figure 7:
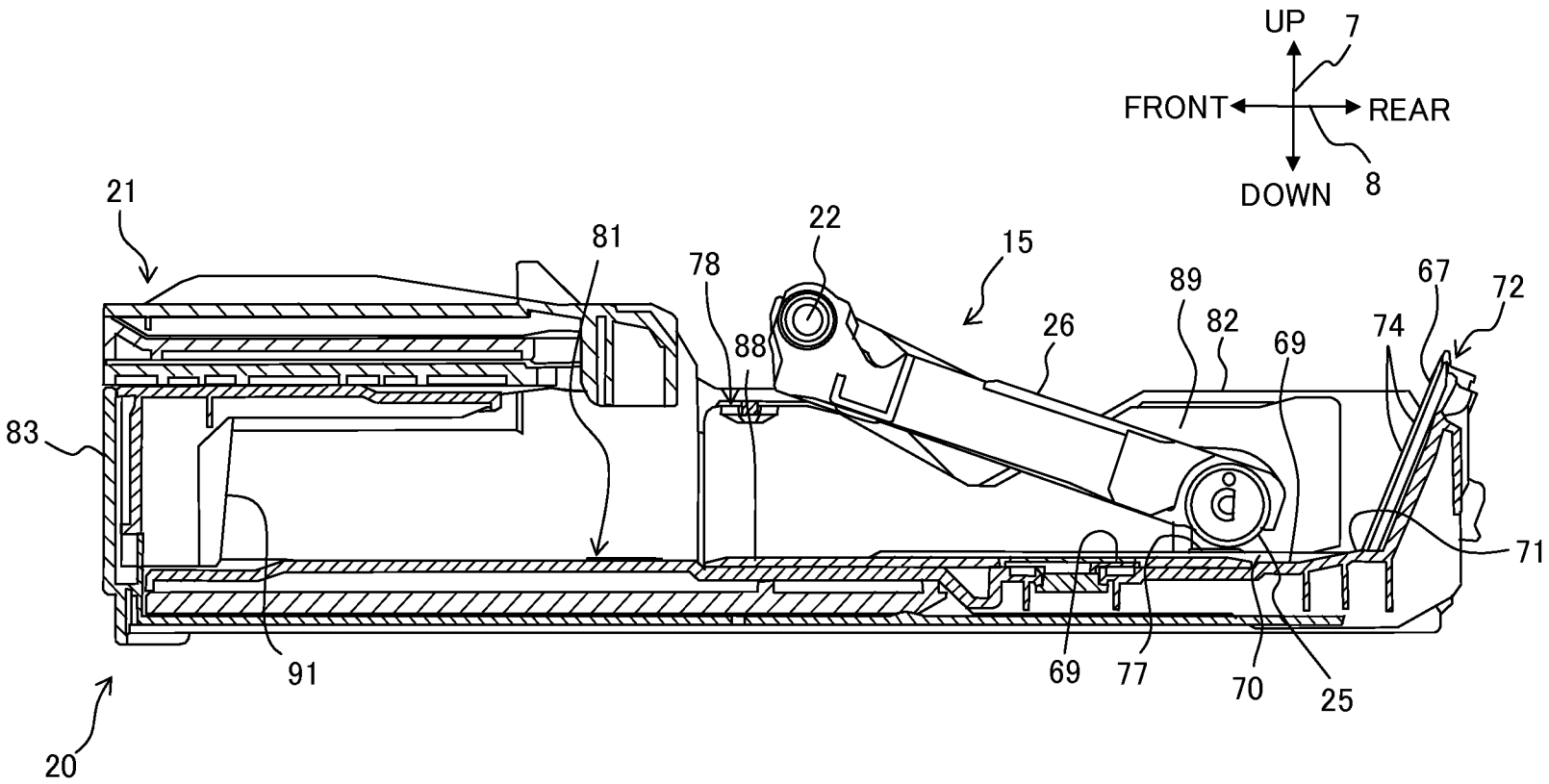
FIG. 7 is a cross-sectional view depicting a cross section along the line VII-VII of FIG. 4.

As depicted in FIG. 7, at the side of the front end of the support plate 81 in the front-rear direction 8, a rear guide 91 is provided to project upward from the upper surface of the support plate 81. The rear guide 91 is movable relative to the support plate 81 in the front-rear direction 8. With respect to the recording sheet 12 supported by the support plate 81, the respective guide portions 89 of the pair of side guides 78 contact with the two ends in the left-right direction 9, while the rear guide 91 contacts with the front end in the front-rear direction 8, such that the recording sheet 12 of various sizes may be positioned on the support plate 81. The center of the recording sheet 12 positioned on the support plate 81 coordinates with the center of the support plate 81 in the left-right direction 9. That is, the recording sheet 12 in the feed tray 20 is positioned on a centering basis.

As depicted in FIG. 3, the feed tray 20 has a pair of projections 75 provided to stand upward from the rear end of the support plate 81, that is, the end on the downstream side in the direction for the feed tray 20 to enter the case 14. The respective projections 75 are arranged in symmetrical positions in the left-right direction 9 with respect to the center of the support plate 81. The length of space between the pair of projections 75 in the left-right direction 9 is shorter than the length of the recording sheet 12 of the smallest size in the left-right direction 9 among the various sizes of recording sheets 12 placed on and fed from the feed tray 20.

Each of the projections 75 extends rearward from the rear end of the support plate 81 in the front-rear direction 8 to form an L shape extending upward in the up-down direction 7 from its extended end. In a state that the feed tray 20 is removed from the case 14, each of the projections 75 prevents the recording sheet 12 supported by the support plate 81 from popping out of the rear-end side.

As depicted in FIG. 4, in a state that the feed tray 20 is installed in the case 14, the projections 75 are respectively embedded in recesses 76 formed in the guide member 72. In this state, each of the projections 75 is located at the rear side from the inclined surface 67 of the guide member 72 in the front-rear direction 8. Therefore, in the state that the feed tray 20 installed in the case 14, neither of the projections 75 may contact with the recording sheet 12 fed along the inclined surface 67.

<Image Recording Operation>

A description will be made below on an operation of the printer unit 11 in which an image is recorded on the recording sheet 12 fed from the feed tray 20.

Figure 8:
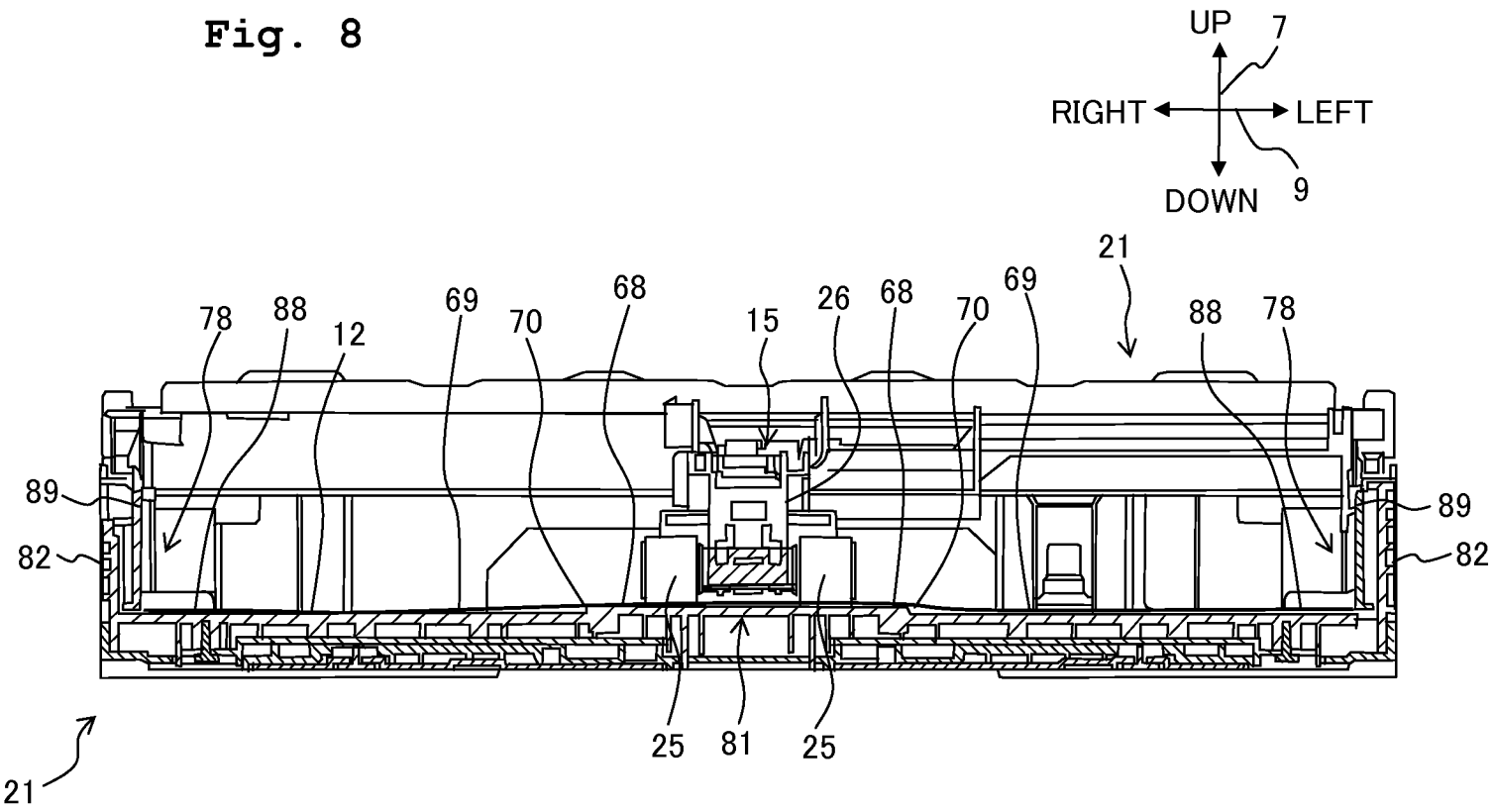
FIG. 8 is a cross-sectional view depicting a cross section along the line VIII-VIII of FIG. 4.

As depicted in FIG. 8, a plurality of recording sheets 12 supported on the support plate 81 of the feed tray 20 are supported by the first support surface 68 and the second support surfaces 69 of the support plate 81. On the immediate upstream of the inclined surface 67 of the guide member 72 in the feed direction 17, the first support surface 68 is situated on the upside (higher) in the up-down direction 7 while the second support surfaces 69 are situated on the downside (lower) in the up-down direction 7. Therefore, on the immediate upstream of the inclined surface 67 in the feed direction 17, the recording sheets 12 are bent domically (to form an upward convex shape) such that central portions are heightened while left side portions and right side portions are both lowered in the left-right direction 9. Note that, in FIG. 8, while the recording sheets 12 are illustrated by a thick line, this thick line represents a plurality of recording sheets 12 in a stacked state.

When the image recording operation is started, the feed unit 15 feeds, in the feed direction 17, the topmost recording sheet 12 among the plurality of recording sheets 12 supported by the support plate 81 of the feed tray 20. If the recording sheets 12 bent as described above are fed in the feed direction 17, then the separating teeth 74 first contact with such a part of the recording sheets 12 as to correspond to the central portion 86 of the guide member 72, that is, the peak of the domical shape, with respect to the inclined surface 67 curved such that the central portion 86 is situated at the front side of the end portions 87 in the left-right direction 9. Therefore, the force in the feed direction imparted by the feed roller 25 is transmitted efficiently as the force for the recording sheet 12 to abut against the separating teeth 74.

By abutting against the separating teeth 74, the topmost recording sheet 12, to which the force in the feed direction 17 is imparted by the feed roller 25, passes over the separating teeth 74, and is guided by the inclined surface 67 of the guide member 72 to move from the feed direction 17 to the obliquely rearward and upward direction (to the conveyance direction 16). If the underlaid recording sheets 12 are entrained by the topmost recording sheet 12 to move in the feed direction 17 due to friction, static electricity, or the like, then the underlaid recording sheets 12 come to contact with the separating teeth 74 to be stopped from moving in the feed direction 17.

On the other hand, being supported by the second support surfaces 69 in the feed tray 20, the recording sheet 12 is bent obliquely rearward and upward by the inclined surfaces 71 at the sides of the left and right ends and at the side of the downstream end in the feed direction 17. Both left end side and right end side of the topmost sheet 12, on which the force in the feed direction 17 is imparted by the feed roller 25, abut against the inclined surface 67, which is curved such that the central portion 86 is situated at the front side of the end portions 87 in the left-right direction 9, at such an angle as to form a gentler slope than the central portion of the recording sheet 12 supported by the first support surface 68. Then, the inclined surface 67 also guides the parts of the topmost recording sheet 12 at the sides of the left and right ends from the feed direction 17 to the obliquely rearward and upward direction (to the conveyance direction 16).

Because the recording sheet 12 is guided by the inclined surface 67 of the guide member 72 to come into the conveyance path 65 and then conveyed along the curved portion 33, the conveyance direction 16 changes from the obliquely rearward and upward direction to an approximately upward direction. Thereafter, when the recording sheet 12 is conveyed along the curved portion 33 to reach the linear portion 34, the conveyance direction 16 for the recording sheet 12 changes from the approximately upward direction to a frontward direction. Then, the recording unit 24 records an image on the recording sheet 12 conveyed along the linear portion 34. The discharge roller pair 59 transports the recording sheet 12 with the image recorded thereon in the frontward direction (in the conveyance direction 16) to discharge the same to the discharge tray 21.

Effects of the Embodiment

According to the above embodiment, the recording sheet 12 on the support plate 81 of the feed tray 20 is domically bent by the first support surface 68 and the second support surfaces 69 such that its peak comes to contact with the separating teeth 74 at the beginning of the feeding. Therefore, the ability to separate the recording sheets 12 in the feeding is improved.

Further, because the step surfaces 70 are formed between the first support surface 68 and the second support surfaces 69 to bend the recording sheet 12 domically due to the boundaries between the first support surface 68 and the step surfaces 70, it is easy to design the bending flexure of the recording sheet 12 on the support plate 81.

Further, because the feed tray 20 is provided with the pair of side guides 78, the peak of the domically bent recording sheet 12 is constantly in contact with the separating teeth 74.

Further, the side guides 78 have the support portions 88 supporting the recording sheet 12, and the upper surfaces of the support portions 88 are situated below the first support surface 68 in the up-down direction 7. Therefore, even if the recording sheet 12 has a high rigidity as with gloss paper for example, or even if the pair of side guides 78 have a narrow interval, both sides of the recording sheet 12 in the left-right direction 9 will still never rise above the central part supported by the first support surface 68.

Further, because the support plate 81 of the feed tray 20 is formed with the inclined surfaces 71 on the immediate upstream of the support plate 81 in the feed direction 17 and at both sides of the first support surface 68 in the left-right direction 9, the inclined surface 67 of the support plate 81 may smoothly guide both side portions, of the recording sheet 12 supported by the second support surfaces 69, in the left-right direction 9.

What is claimed is:

1. A sheet conveyance apparatus comprising:

a support member having a support surface configured to support sheets in a stacked state;

a feed unit configured to feed the sheets stacked on the support surface in a feed direction;

a guide member provided on a downstream side of the support member in the feed direction, and having an inclined surface which is inclined with respect to the support surface such that one end on a downstream side in the feed direction is located above the other end on an upstream side in the feed direction and which is configured to abut against the sheets fed by the feed unit and to guide the sheets along the feed direction;

a separating member projecting from the inclined surface toward a side of the support surface and configured to separate the topmost sheet from the other sheets fed by the feed unit, wherein the inclined surface is curved such that a separating area in which the separating member is provided is closest to the side of the support surface, and the support surface includes:

a first support surface arranged on a downstream side of the feed unit in the feed direction to be adjacent to the separating area on an upstream side of the separating area in the feed direction, and second support surfaces arranged respectively on both sides of the first support surface in a direction orthogonal to the feed direction, wherein the second support surfaces are positioned lower than the first support surface in the gravity direction;

a guide surface which extends in the feed direction between the inclined surface and the second support surfaces, which overlaps with the first support surface at least partially when viewed in the direction orthogonal to the feed direction, and which is inclined with respect to the support surface and the inclined surface such that one end on a downstream side in the feed direction is located above the other end on an upstream side in the feed direction, wherein the guide surface extends further in the feed direction than a downstream end of the first support surface in the feed direction, from downstream ends of the second support surfaces in the feed direction; and a pair of side guides projecting upward from the second support surfaces respectively, and configured to guide the sheets supported by the first support surface and the second support surfaces along the feed direction while abutting against the sheets at both ends in the direction orthogonal to the feed direction respectively, wherein each of the side guides has a third support surface configured to support the sheets, wherein the third support surfaces are positioned lower than the first support surface in the gravity direction.

2. The sheet conveyance apparatus according to claim 1, wherein a step surface is formed between the first support surface and each of the second support surfaces.

3. The sheet conveyance apparatus according to claim 1, wherein the feed unit includes:

a roller configured to rotate in the feed direction; and an arm configured to support the roller at one end portion thereof and to be pivotable in directions in which the roller contacts with and separates from the support surface with the other end portion thereof as a pivot shaft.

4. An image recording apparatus comprising:

the sheet conveyance apparatus as defined in claim 1; and a recording unit configured to record images on the sheets conveyed by the sheet conveyance apparatus.

5. A feed tray comprising:

a support surface configured to support a sheet to be fed in a predetermined feed direction, wherein the support surface includes:

a first support surface arranged on one end side in the feed direction; and second support surfaces arranged respectively on both sides of the first support surface in a direction orthogonal to the feed direction, wherein the second support surfaces are positioned lower than the first support surface in the gravity direction;

a guide surface which extends further in the feed direction than a downstream end of the first support surface in the feed direction, from downstream ends of the second support surfaces in the feed direction, which overlaps with the first support surface at least partially when viewed in the direction orthogonal to the feed direction, and which is inclined such that one end on a downstream side in the feed direction is located above the other end on an upstream side in the feed direction; and a pair of side guides projecting upward from the second support surfaces respectively, and configured to guide the sheets supported by the first support surface and the second support surfaces along the feed direction while abutting against the sheets at both ends in the direction orthogonal to the feed direction respectively, wherein each of the side guides has a third support surface configured to support the sheets, wherein the third support surfaces are positioned lower than the first support surface in the gravity direction.

* * * * *